US006257555B1

(12) United States Patent
Barbara

(10) Patent No.: US 6,257,555 B1
(45) Date of Patent: Jul. 10, 2001

(54) STUMP AND POLE EXTRACTION DEVICE

(76) Inventor: David Michael Barbara, 321 Stoneledge, Irving, TX (US) 75063

( * ) Notice: Subject to any disclaimer, the term of this patent is extended or adjusted under 35 U.S.C. 154(b) by 0 days.

(21) Appl. No.: 09/503,910

(22) Filed: Feb. 15, 2000

(51) Int. Cl.[7] ..... B66D 1/00

(52) U.S. Cl. ..... 254/264; 254/266; 248/163.1; 248/168

(58) Field of Search ..... 254/213, 227, 254/263, 264, 266; 248/163.1, 168, 169

(56) References Cited

U.S. PATENT DOCUMENTS

| | | | | |
|---|---|---|---|---|
| 153,719 | | 8/1874 | Mulholen . | |
| 218,725 | | 8/1879 | Frederick . | |
| 236,829 | | 1/1881 | Merchant . | |
| 840,942 | | 1/1907 | Huckle . | |
| 914,920 | | 3/1909 | Bradley . | |
| 1,553,692 | | 9/1925 | Huckle . | |
| 4,203,242 | * | 5/1980 | Griffin | 248/168 |
| 4,469,307 | * | 9/1984 | Bell | 254/227 |
| 4,796,843 | * | 1/1989 | O'Connor | 248/168 |
| 4,852,836 | * | 8/1989 | Kawazoe | 248/168 |
| 4,997,152 | * | 3/1991 | Wagman et al. | 248/168 |
| 5,284,324 | * | 2/1994 | Bunger | 254/266 |
| 5,417,406 | | 5/1995 | Franchier, Jr. . | |
| 6,056,273 | * | 5/2000 | Smith | 254/266 |

* cited by examiner

*Primary Examiner*—Katherine A. Matecki
(74) *Attorney, Agent, or Firm*—Stephen R. Greiner

(57) ABSTRACT

A device for extracting stumps and poles from the ground. The device includes a pair of legs each having an upper end and a lower end. A pivot pin, adapted to suspend a winch above the ground, hingedly joins the legs together at their upper ends. A pair of ground-engaging feet are secured to the lower ends of the legs and extend laterally therefrom. A flexible connector selectively connects the feet together and may be retracted into one of the legs.

7 Claims, 2 Drawing Sheets

STUMP AND POLE EXTRACTION DEVICE

FIELD OF THE INVENTION

The present invention relates generally to apparatus for applying pushing or pulling force and, more particularly, to portable implements for extracting stumps or poles from the ground.

BACKGROUND OF THE INVENTION

Wooden fence posts are often anchored to the ground by concrete. After prolonged exposure to the weather, these posts rot necessitating removal of the concrete "stump" so that replacement posts can be installed. Unfortunately, concrete stump removal is a backbreaking task most often performed by first digging a hole around the stump and, then, lifting the stump from the hole and onto a truck for off-site disposal. A pair of laborers can perform this procedure in several hours using hand tools like shovels and pry bars. Inadvertently dropping the stump onto the foot or leg of a laborer is not uncommon and can result in a serious injury.

SUMMARY OF THE INVENTION

In light of the problems associated with the prior art, it is a principal object of the invention to provide a lifting device that may be used to extract concrete stumps and other objects such as poles, pipes and shrubs from the ground with great ease, speed, and safety. Use of the device does not place the operator in direct contact with the object being extracted from the ground. The device is, thus, a cost-effective alternative to hand tools.

It is another object of the invention to provide a device of the type described that can be: set up, used, and taken down by a single person without resort to special tools or extensive training. In some instances of use, these steps can be performed in a few minutes.

It is a further object of the invention to provide a stump and pole extraction device whose height and width are adjustable to suit local terrain and space limitations. The device can also be folded flat for compact storage.

It is an object of the invention to provide improved elements and arrangements thereof in a stump and pole extraction device for the purposes described which is lightweight in construction, inexpensive to manufacture, and dependable in use.

Briefly, the stump and pole extraction device in accordance with this invention achieves the intended objects by featuring a pair of legs hingedly joined at their upper ends by a pivot pin suspending a winch above the ground. One of the legs has an interior cavity therein and an aperture located between its upper end and its lower end that provides access to the interior cavity. A pair of ground-engaging feet are secured, respectively, to the lower ends of the legs and extend laterally therefrom. One link of a chain is affixed within the interior cavity whereas another of the chain links is adapted for releasable attachment to the foot on the opposite leg. The chain is adapted for positioning within the interior cavity for convenient storage and for selective extension through the aperture for use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
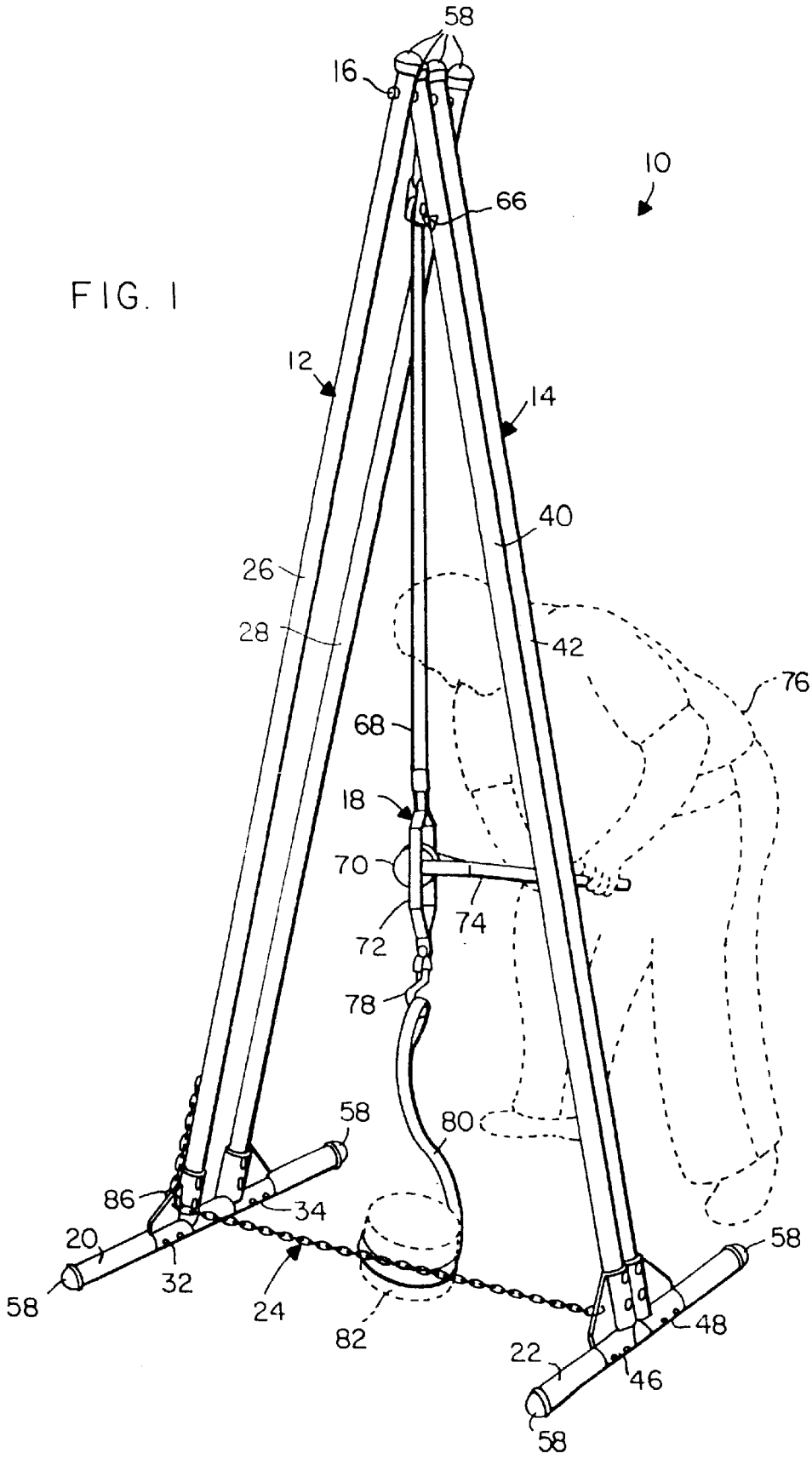
FIG. 1 is a perspective view of a stump and pole extraction device in accordance with the present invention.
Figure 2:
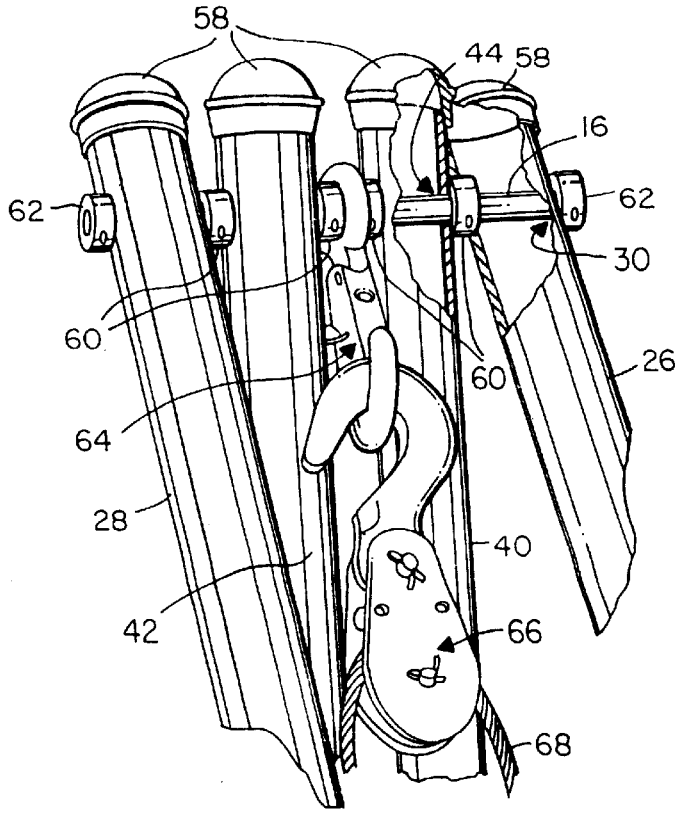
FIG. 2 is a perspective view of the top of the device of FIG. 1 with portions broken away to reveal details thereof.
Figure 3:
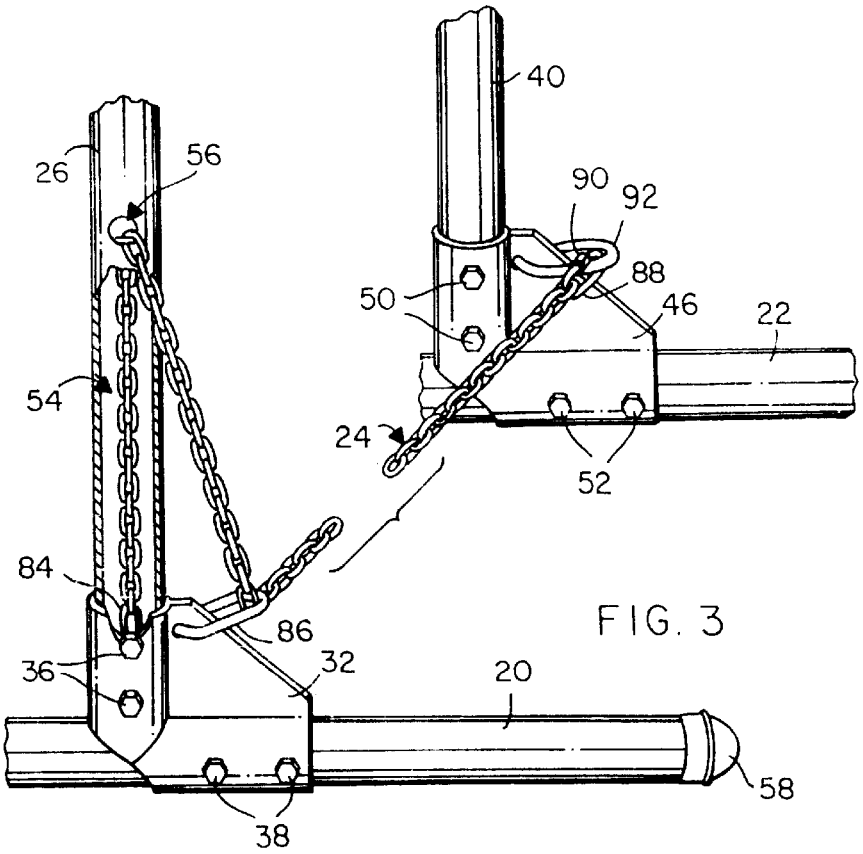
FIG. 3 is a perspective view of the bottom of the device with portions broken away.

Referring now to the FIGS., a stump and pole extraction device in accordance with the present invention is shown at 10. Device 10 includes a pair of legs 12 and 14 hingedly joined together at their upper ends by a pivot pin 16 from which a winch 18 is suspended. Affixed to the lower ends of legs 12 and 14 are ground-engaging feet 20 and 22. Feet 20 and 22 are joined by a flexible connector 24 that serves to set the position of feet 20 and 22 on the ground and prevents the collapse of device 10 during use.

Leg 12 includes two, tubular members 26 and 28 positioned side-by-side. The tops of tubular members 26 and 28 are provided with axially aligned apertures as at 30 for receiving pivot pin 16. The bottoms of tubular members 26 and 28 are fitted into angle brackets 32 and 34 that join tubular members 26 and 28 to the center portion of foot 20. Brackets 32 and 34 are held in place by a plurality of threaded fasteners 36 penetrating brackets 32 and 34 and tubular members 26 and 28 as well as threaded fasteners 38 penetrating brackets 32 and 34 and foot 20.

A pair of side-by-side, tubular members 40 and 42 comprise leg 14. Axially aligned apertures as at 44 are provided in the tops of tubular members 40 and 42 for pin 16. Angle brackets 46 and 48 are affixed by means of threaded fasteners 50 to the bottoms of tubular members 40 and 42. Threaded fasteners 52 secure brackets 46 and 48 to foot 22.

Tubular members 26, 28, 40 and 42 and feet 20 and 22 are formed of lightweight, metallic tubing. Tubular members 26, 28, 40 and 42 all measure about 7 feet (2.1 m) in length and 1⅝ inches (4.1 cm) in diameter. As shown, tubular member 26 has an interior cavity 54 and an aperture 56 at a predetermined height above foot 20 which provides access to interior cavity 54. Each foot 20 and 22 is about 2 feet (61 cm) in length and has a diameter similar to that of the tubular members. Caps 58 are secured to the upper ends of tubular members 26, 28, 40 and 42 as well as the opposed ends of feet 20 and 22 to prevent the entry of dirt.

Pivot pin 16 passes through apertures 30 and 44 to hingedly join legs 12 and 14. To prevent legs 12 and 14 from binding against one another, set screw-retained collars 60 are positioned on pin 16 between tubular members 26, 28, 40 and 42. Similar collars 62 are secured to the opposed ends of pin 16 to lock tubular members 26, 28, 40 and 42 therebetween.

A link 64 suspends a pulley 66 from pin 16 at a set distance from feet 20 and 22. A cable 68 extends from the rotatable drum 70 of winch 18 over pulley 66 and back to the drum-carrying frame 72 of winch 18 where it is securely fastened. By manually reciprocating winch lever 74, a user 76 of device 10 can selectively extend or retract cable 68 from drum 70 to raise and lower winch 18 with a mechanical advantage. A hook 78 secured to the bottom of winch 18 retains a sling 80 which may be wrapped around an object to be lifted such as concrete stump 82.

Flexible connector 24 is preferably a retractable chain formed from a plurality of interconnected links. One link at

84 is affixed at the bottom of interior cavity 54 by a threaded fastener 36 running through its center. The chain extends upwardly away from link 84, out aperture 56 and through a ring 86 fastened to bracket 32. Another link 88 at the opposite end of connector 24 has a rotatable nut 90 that permits such to be selectively opened into a C-shape for releasable attachment to a ring 92 carried by bracket 46.

When use of the chain is not required, it may be fed under the influence of gravity through aperture 56 and into interior cavity 54 for storage. Interior cavity 54 is, of course, dimensioned to receive the entirety of the chain. Nonetheless, by providing link 88 with a somewhat larger size than aperture 56, a stop feature can be provided to the chain that permits one end thereof to always be accessible. Thus, the chain can be easily extended from interior cavity 54 when its use is required.

Use of device 10 is straightforward. First, user 76 positions feet 20 and 22 on opposite sides of an object being lifted from the ground like stump 82. Then, flexible connector/chain 24 is extended from interior cavity 54 by pulling link 88 away from aperture 56 and through ring 86. Next, link 88 is attached to ring 92 by rotating nut 90 to open and, later, close link 88 on ring 92. Afterward, pulley 66 and winch 18 are suspended from pivot pin 16 and sling 80 is wrapped around stump 82. When sling 80 is secure, stump 82 is lifted from the ground by reciprocating winch lever 74. The elevated stump 82 can now be positioned on a cart (not shown) for transport off site. The entire process requires just minutes to finish and can be performed in complete safety.

While the invention has been described with a high degree of particularity, it will be appreciated by those skilled in the art that modifications may be made thereto. For example, each of legs 12 and 14 could be provided with one tubular member rather than the pairs 26-28 and 40-42 shown. Also, a cable or rope could be substituted for the preferred chain used in flexible connector 24. Therefore, it is to be understood that the present invention is not limited to the sole embodiment described above, but encompasses any and all embodiments within the scope of the following claims.

I claim:

1. A device for use in conjunction with a winch for the extraction of stumps and poles from the ground, said device comprising:

a pair of legs each having an upper end and a lower end;

a pivot pin hingedly joining said legs together at said upper ends thereof, said pivot pin being adapted to suspend a winch above the ground;

a pair of ground-engaging feet being respectively secured to said lower ends of said legs, said feet extending laterally from said legs; and, a flexible connector retractable into one of said legs adapted to selectively connect said feet together.

2. The stump and pole extraction device according to claim 1 wherein each of said legs includes a pair of tubular members and said flexible connector being retractable into one of said tubular members of one of said legs.

3. The stump and pole extraction device according to claim 1 further comprising a winch suspended from said pivot pin.

4. The stump and pole extraction device according to claim 1 wherein said flexible connector is a chain.

5. A stump and pole extraction device, comprising:

a first leg and a second leg each having an upper end and a lower end, said first leg also having an interior cavity therein and an aperture located between said upper end and said lower end thereof providing access to said interior cavity;

a pivot pin hingedly joining said first leg and said second leg together at said upper ends thereof;

a winch suspended from said pivot pin;

a first ground-engaging foot and a second ground-engaging foot secured, respectively, to said lower ends of said first leg and said second leg and extending laterally therefrom; and, a chain formed from a plurality of interconnected links, one of said links being affixed within said interior cavity, another of said links being adapted for releasable attachment to said second foot, said chain being adapted for positioning within said interior cavity for storage and for selective extension through said aperture for use.

6. The stump and pole extraction device according to claim 5 wherein first leg and said second leg both include a pair of tubular members positioned side by side.

7. A stump and pole extraction device, comprising:

a first leg and a second leg each having an upper end and a lower end and being formed from a pair of side-by-side tubular members, one of said tubular members of said first leg also having an interior cavity therein and an aperture providing access to said interior cavity;

a pivot pin hingedly joining said first leg and said second leg together at said upper ends thereof;

a winch suspended from said pivot pin;

a first ground-engaging foot and a second ground-engaging foot secured, respectively, to said lower ends of said first leg and said second leg and extending laterally therefrom; and, a chain formed from a plurality of interconnected links, one of said links being affixed within said interior cavity, another of said links being adapted for releasable attachment to said second foot, said chain being adapted for positioning within said interior cavity for storage and for selective extension through said aperture for use.

* * * * *